US007229346B1

(12) United States Patent
Minker

(10) Patent No.: US 7,229,346 B1
(45) Date of Patent: Jun. 12, 2007

(54) FINGER-MOUNTED TOOL DEVICE

(76) Inventor: Gary A. Minker, 7225 Catilina Island Dr., Lake Worth, FL (US) 33467

( * ) Notice: Subject to any disclaimer, the term of this patent is extended or adjusted under 35 U.S.C. 154(b) by 0 days.

(21) Appl. No.: 11/400,826

(22) Filed: Apr. 10, 2006

(51) Int. Cl.
*B24D 15/00* (2006.01)
*A47L 13/18* (2006.01)

(52) U.S. Cl. ..... 451/523; 451/526; 2/163; 15/227

(58) Field of Classification Search ..... 15/167.1, 15/227, 244.1; 2/161.8, 163; 451/523, 526, 451/540, 490, 495
See application file for complete search history.

(56) References Cited

U.S. PATENT DOCUMENTS 4,384,382 A * 5/1983 Diamant ..... 15/104.001
4,593,427 A * 6/1986 Ortolivo ..... 15/227
4,825,470 A * 5/1989 Horio ..... 2/161.8

* cited by examiner

*Primary Examiner*—Jacob K. Ackun, Jr.
(74) *Attorney, Agent, or Firm*—Davis Chin

(57) ABSTRACT

A finger-mounted tool device includes a finger-gripping sleeve formed of a hollow body tube and an abrading member. The hollow body tube is formed of a spirally wrapped progression of a spring material to provide an expanding and gripping nature and is bi-directional in use for fitting securely and comfortably onto any size of a user's finger. The abrading member has an abrasive surface and a backing surface. The backing surface is attached to the body tube.

20 Claims, 3 Drawing Sheets

FINGER-MOUNTED TOOL DEVICE

BACKGROUND OF THE INVENTION

1. Field of the Invention

This invention relates generally to finger-mounted devices, and more particularly, the present invention relates to an improved finger-mounted tool device which includes a finger-gripping sleeve formed of a bi-directional spirally wrapped spring tube for receiving a user's finger and for securely maintaining the finger onto the device during continuous use.

2. Description of the Prior Art

Over the many past years, people have discovered that reducing the cumbersome use of hand-held devices and replacing them with finger-mounted devices allows the user to have more precision in their operation, to be more practical for use in space-confined areas and to be more convenient for traveling purposes. The applications for these finger-mounted devices have varied greatly from teeth cleaning to the removal of residue from encrusted objects.

For example, in regards to the application of teeth cleaning, there are numerous patents known in the art which disclose designs for these finger-mounted devices. Generally, the teeth cleaning finger devices are typically designed to include a brush on the exterior tip of the device and, opposite the tip end, a finger-receiving open-end portion, which allows the device to be mounted onto a finger. Similarly, in regards to the application of removing residue or unwanted material from an object, the finger-mounted device of the prior art, likewise, includes an abrasive material on the exterior tip of the device and, opposite the tip end, a finger-receiving open-end portion, which allows the device to be mounted onto a finger.

However, all of these early prior art designed finger-mounted devices suffered from a major disadvantage wherein the finger would slip out of the device during its operation. In view of this problem, attempts have been made heretofore to develop new implementations so as to reduce finger slippage when the device is in use. For example, one such improvement included a non-slip lining disposed within the device. Another example uses a rubber cushion member which is located at the finger-receiving open-end portion of the device. Although these improvements may have performed adequately so as to keep the finger from accidentally slipping from the device, these improvements did not ensure that the device would be fixedly secured to the finger so that the attached abrading material would remain in a stationary position during use.

Therefore, it should come as no surprise that modern finger-mounted devices have been developed and constructed heretofore in the prior art so as to prevent the finger from slipping out of the device while in use. In spite of these efforts in the prior art, it would be still desirable to provide an improved finger-mounted device which would prevent the finger from slipping and maintaining the attached abrading member on the device in a stationary position during operation.

A prior art search directed to the subject matter of this application in the U.S. Patent and Trademark Office revealed the following Letters Patent:

U.S. Pat. Nos. 1,157,413
2,167,129
3,643,386
5,327,688
5,765,252

6,584,637
6,808,068

Further, the prior art search also revealed Patent Application Publication Nos. 2003/0088930 dated May 15, 2003 to Abada and 2002/0152538 dated Oct. 24, 2002 to McDevitt et al.

In U.S. Pat. No. 5,327,688 to Norkus issued on Jul. 12, 1994, there is disclosed a digital abrading jacket having a sleeve, which is open at one end and open at the opposite end, sized and shaped to accommodate a human finger or thumb. At the closed end of the sleeve is fastened an elongated panel approximately the same length as the sleeve. The free end of the panel defines a ribbed skirt, which has a rougher surface texture than the remainder of the panel so as to provide a better holding or gripping surface for the fingers or thumb. On the outer surface of the sleeve is a fixed array of abrasive elements.

In U.S. Pat. No. 5,765,252 to Carr issued on Jun. 16, 1998, there is taught a finger brush, which is secured to a finger by an interior surface having non-slip lining or surface character such that the device is maintained on a fingertip and along the length of a finger as a sheath portion is unrolled along the finger into a position of use. The brush device includes a tip portion having a closed end with a plurality of bristles mounted on the exterior surface of the tip portion. In a child version of the device, an anchor ring is used to secure the finger mounted brush to an adjacent finger of a child to prevent accidental removal. This '252 patent also discloses a hand mounted glove which incorporates the principles of the finger brush.

In U.S. Pat. No. 2,167,129 to Sleeper issued on Jul. 25, 1939, there is taught a brush which may be mounted on a finger tip. In order to prevent accidental withdrawal of the brush from the finger, the device includes a rubber cushion member located at the open end of the body.

U.S. Patent Application Publication No. 2002/0152538 to McDevitt et al. published on Oct. 24, 2002, discloses a finger glove. This finger glove may be designed with a tapered shape to enhance the ability of the glove to fit onto a finger. Additionally, the finger glove may also be designed to have two open ends so that a finger can be inserted completely therethrough.

The remaining patents, listed above but not specifically discussed, are deemed to be only of general interest and show the state of the art in finger-mounted devices.

None of the prior art discussed above disclosed a finger-mounted tool device like that of the present invention which includes a finger-gripping sleeve formed of a bi-directional spirally wrapped spring tube for receiving a user's finger and for securely maintaining the device onto the finger. The finger-mounted tool device is attached to a backing surface of an abrading member.

SUMMARY OF THE INVENTION

Accordingly, it is a general object of the present invention to provide an improved finger-mounted tool device which prevents the finger from accidentally slipping from the device during use and overcomes the disadvantages of the prior art.

It is an object of the present invention to provide an improved finger-mounted tool device which includes a finger-gripping sleeve and an abrading member having its backing surface secured to the sleeve.

It is another object of the present invention to provide an improved finger-mounted tool device which is cost effective to manufacture and which is relatively easy and non-problematic to use in operation.

In a preferred embodiment of the present invention, there is provided a finger-mounted tool device for abrading, filing, sanding or otherwise removing excess or unwanted material from a workpiece. The finger-mounted tool device includes a finger-gripping sleeve formed of a hollow body tube which accommodates a user's finger and an abrading member. The hollow body tube has a first opening at its one end and a second opening at its other end. The hollow body tube is formed of a spirally wrapped progression of a spring material which securely fits onto the user's finger. The abrading member has an abrasive surface and a backing surface. The backing surface is attached to the hollow body tube.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
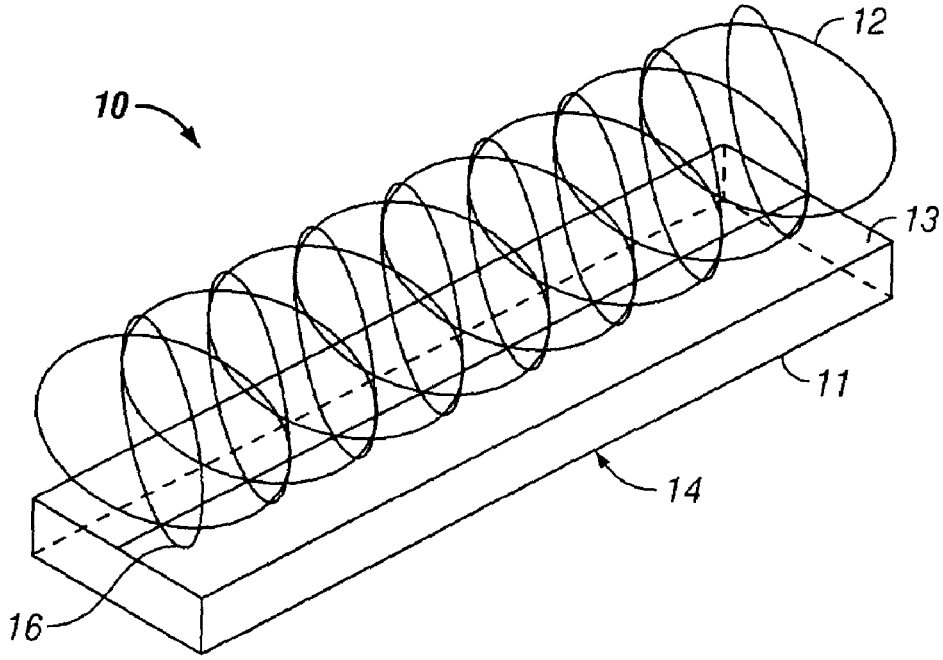
FIG. 1 is a perspective view of a finger-mounted tool device, constructed in accordance with the principles of the present invention.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Figure 2:
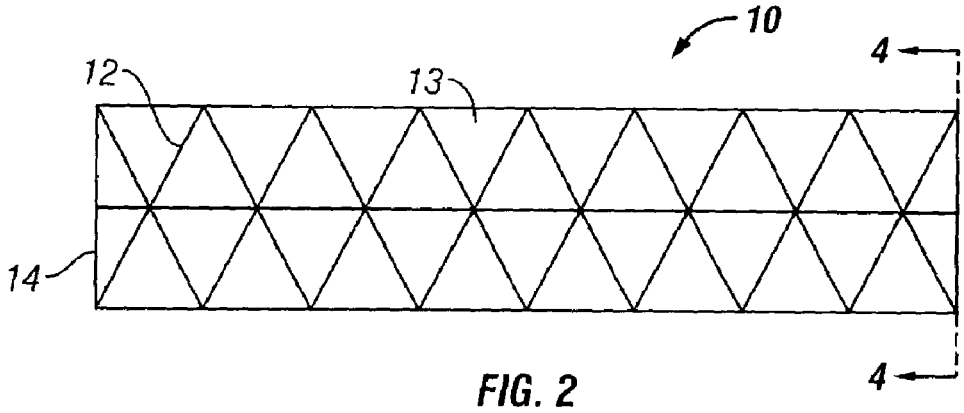
FIG. 2 is a top plan view of the finger-mounted tool device of FIG. 1.
Figure 3:
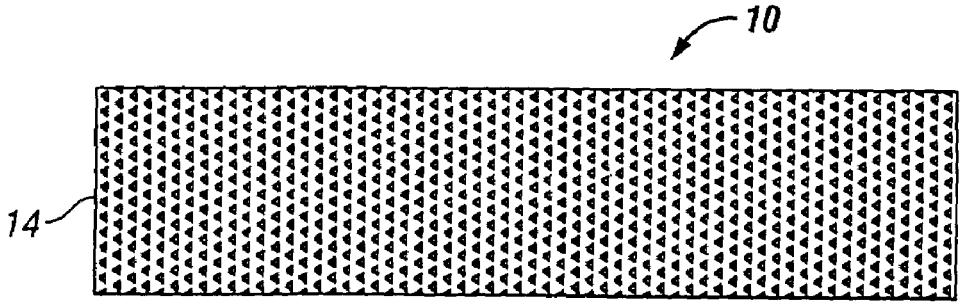
FIG. 3 is a bottom view of the finger-mounted tool device of FIG. 1.
Figure 4:
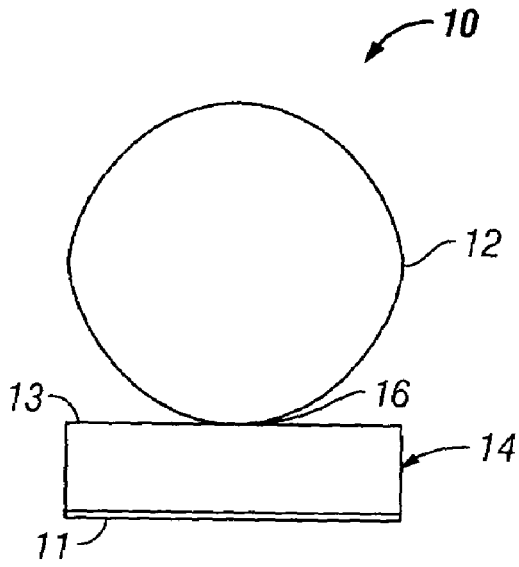
FIG. 4 is an end view of the finger-mounted tool device, taken along the lines 4-4 of FIG. 2.
Figure 5:
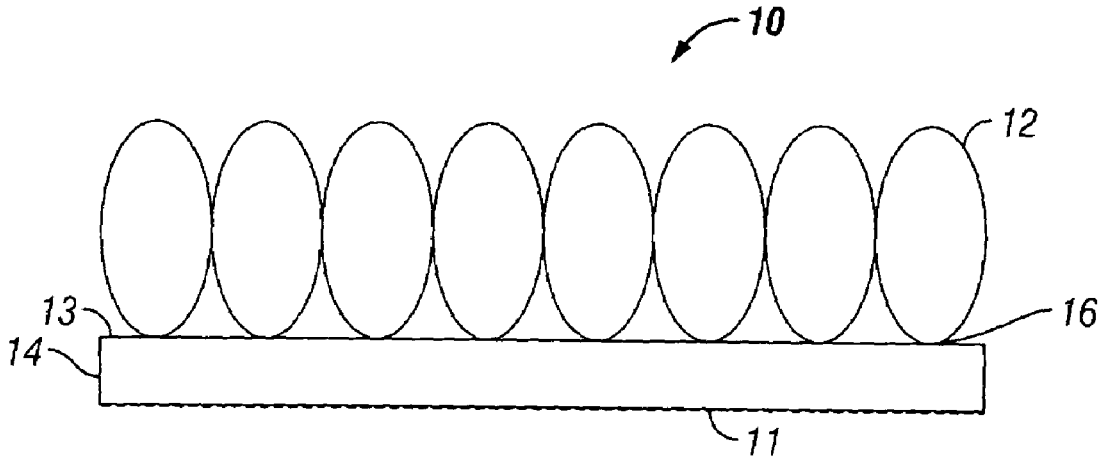
FIG. 5 is a side elevational view of the finger-mounted tool device of FIG. 1.

Referring now in detail to the drawings, wherein like reference characters designate like or corresponding parts throughout the several views, there is illustrated in FIGS. 1 through 5 an improved finger-mounted tool device 10 constructed in accordance with the principles of the present invention. In particular, FIG. 1 is a perspective view of the finger-mounted tool device 10. FIG. 2 is a top plan view of the finger-mounted tool device. FIG. 3 is a bottom view thereof. FIG. 4 is an end view thereof. FIG. 5 is a side view of the finger-mounted tool device 10.

The finger-mounted tool device 10 includes a finger gripping-sleeve formed of a hollow body spring tube 12. The spring tube 12 is of an expanding and gripping nature and is bi-directional in use. In other words, the spring tube 12 is open at one end and open at the opposite end so that a user's finger may be inserted completely through the finger file device 10 in either direction. The spring tube 12 is created from a spirally wrapped progression of spring material. The spring tube 12 may either be flat or round shaped, but is not limited to these shapes. This spiral wrap of spring material first wraps in a progressive spiral from left to right, as viewed from FIG. 5. Once the helical progression of spring material has reached an appropriate length, the direction of the helical progression is reversed to the beginning point. Hence, these progressions are also interweaved so as to emulate a tubular basket effect.

It should be noted that the spring material is preferably formed of metal, such as steel or the like. However, the spring material may be alternatively formed of a plastic material or any other similar non-metallic material. The length of tube may be made to be equal to the length of a user's finger, such as two to four inches. Due to the spiral or helical wrapping nature of the spring material, it can be expanded diametrically so as to accommodate the different thicknesses of the user's fingers.

As illustrated generally in FIGS. 1 through 5, the finger file device 10 includes the finger-gripping sleeve defined by the spring tube 12, an abrading member 14 having an abrading surface 11 and a backing surface 13 and a securing means 16 which secures the spring tube 12 to the backing surface 13 of abrading member 14. The securing means 16 may be, but is not limited to, any bonding agent, epoxy, glue or other adhesive generally known in the industry.

Further, as illustrated in FIG. 5, the abrading member 14 is approximately equal in length to the length dimension of the spring tube 12. The abrading member 14 is formed of a material which is used to remove other materials or portions thereof during modification or construction of a workpiece. The abrading material may include, but is not limited to, fine single cut mill files, coarse single cut mill files, double cut mill files, diamond cut mill files, carborundum, fine sanding materials of selected grade of grit or coarse sanding materials of selected grade of grit. Additionally, the abrading material may be intended for use on non-metallic materials and be constructed as fine or coarse rasp files. Now referring to FIG. 3, it is shown that the abrading member 14 is formed of a rectangular shape having the flat, abrading surface 11.

In use, the finger-mounted tool device 10 of the present invention is operated in the conventional manner as to be propelled forward and backward in a linear or sliding motion relative to a workpiece (not shown) to be abraded so as to remove unwanted materials from the workpiece during modification or change to the shape or purpose thereof. It should be apparent to those skilled in the art that the abrading surface 11 can encompass a multiplicity of shapes, sizes and abrading surface conditions and/or materials.

Figure 6:
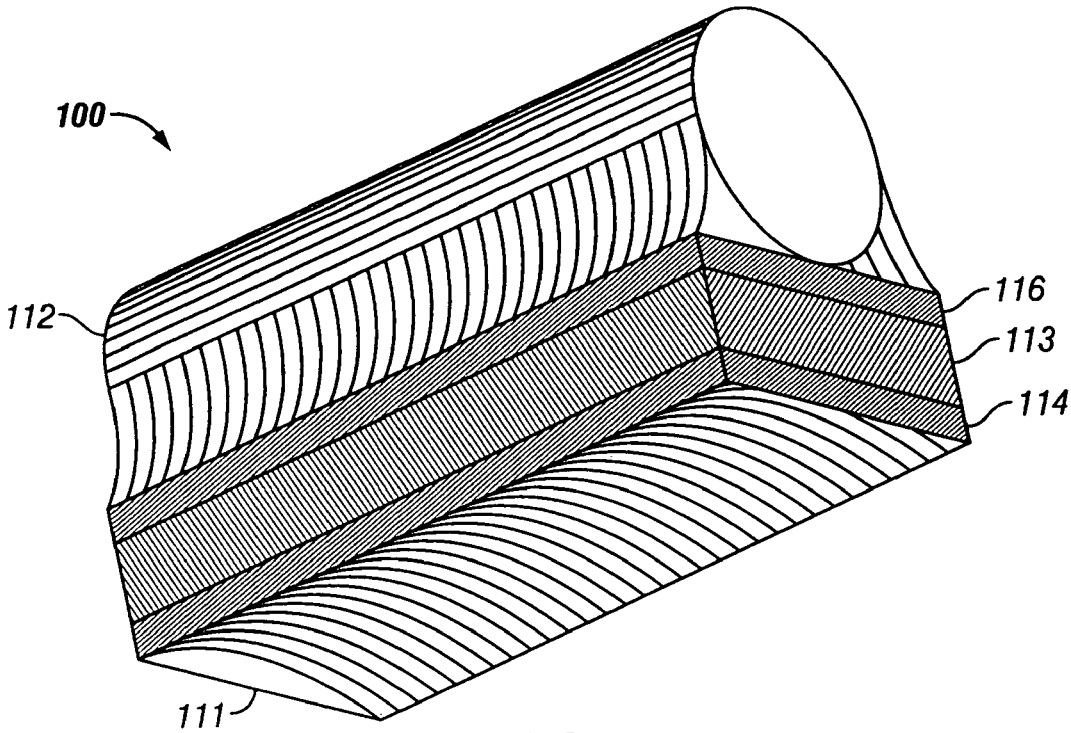
FIG. 6 illustrates an alternative embodiment of the present invention in which the abrading member is of a concave shape.

In FIG. 6, there is shown a first alternative embodiment of a finger-mounted tool device 100 includes the finger-gripping sleeve defined by the spring tube 112, an abrading member 114 having an abrading surface 111 and a backing surface 113 and securing means 116 which secures the spring tube 112 to the backing surface 113 of the abrading member 114. The finger-mounted tool device 100 is substantially identical to the finger-mounted tool device 10, except that the abrading member 114 is formed of a rectangular shape having the abrading surface 111 with a convex contour.

Figure 7:
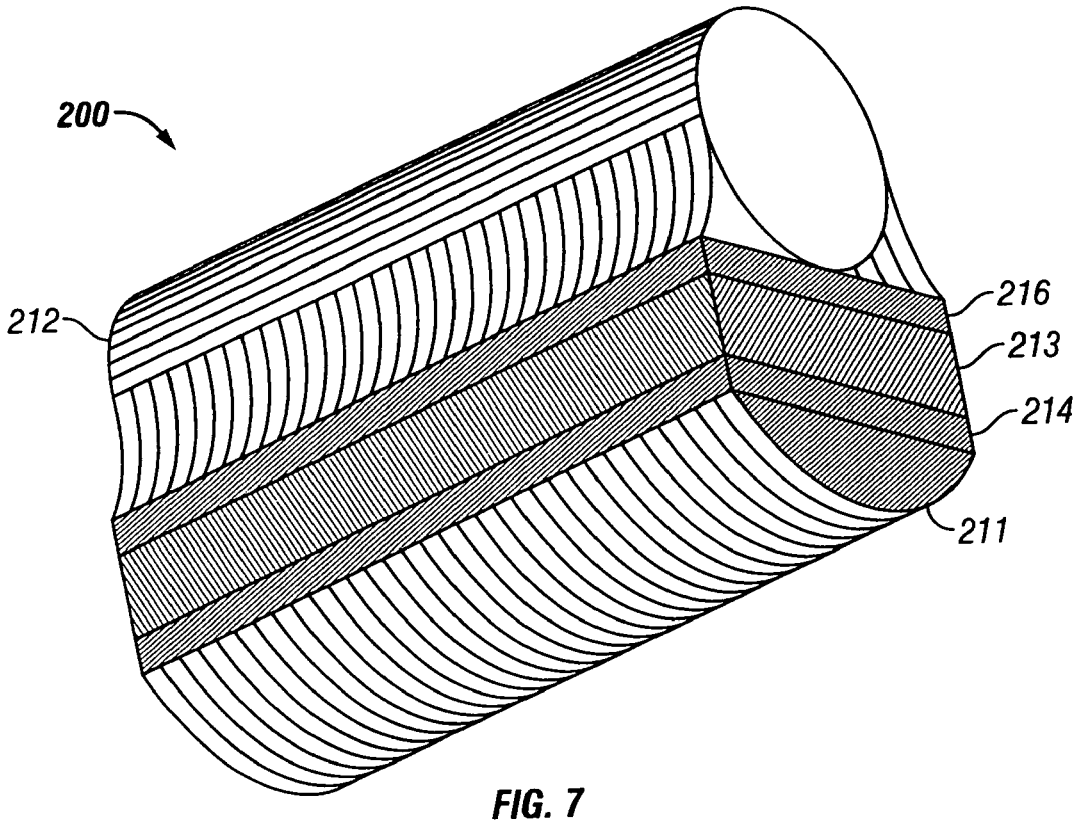
FIG. 7 illustrates another alternative embodiment of the present invention in which the abrading member is of a convex shape.

In FIG. 7, there is shown a second alternative embodiment of a finger-mounted tool device 200 which includes the finger-gripping sleeve defined by the spring tube 212, an abrading member 214 having an abrading surface 211 and a backing surface 213, and securing means 216 which secures the spring tube 212 to the backing surface 213 of the abrading member 214. The tool device 200 is also substantially identical to the tool device 10, except that the abrading member 214 is formed of a rectangular shape having the abrading surface 211 with a concave contour. Additionally, all abrasive surfaces may be flexurally backed with a cushioned material so as to allow for controlled abrading or sanding of curved or non-planar surfaces.

From the foregoing detailed description, it can thus be seen that the present invention provides a finger-mounted tool device which includes a finger-gripping sleeve formed of a bi-directional spirally wrapped spring tube and an abrading member. The sleeve is secured to the backing surface of the abrading member. As a result, the finger-mounted tool device of the present invention is relatively easy to use, prevents accidental slipping of the user's finger from the device and maintains the device in a relatively stationary position on the finger.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A finger-mounted tool device comprising:

a finger-gripping sleeve formed of a hollow body tube which accommodates a user's finger, said hollow body tube having a first opening at one end and a second opening at an opposing end;

said hollow body tube being formed from a spirally wrapped progression of a spring material adapted to securely fit onto the user's finger; and an abrading member having an abrasive surface and a backing surface, said backing surface being attached to said hollow body tube.

2. A finger-mounted tool device as claimed in claim 1, wherein the abrasive surface of said abrading member is formed of a flat shape.

3. A finger-mounted tool device as claimed in claim 1, wherein the abrasive surface of said abrading member is formed of a concave shape.

4. A finger-mounted tool device as claimed in claim 1, wherein the abrasive surface of said abrading member is formed of a convex shape.

5. A finger-mounted tool device as claimed in claim 1, wherein said abrading member has a length which is approximately equal to the length of said hollow body tube.

6. A finger-mounted tool device as claimed in claim 1, wherein the spring material of said hollow body tube is made of a metallic material.

7. A finger-mounted tool device as claimed in claim 1, wherein the spring material of said hollow body tube is made of a plastic or non-metallic material.

8. A finger-mounted tool device comprising:

finger-gripping sleeve means for accommodating a user's finger, said finger-gripping means having a first opening at one end and a second opening at an opposing end;

said finger-gripping sleeve means being formed from a spirally wrapped progression of spring material for securely fitting onto the user's finger; and abrading means being attached to said finger-gripping means for use in removing of unwanted materials from a workpiece.

9. A finger-mounted tool device as claimed in claim 8, wherein the spring material of said finger-gripping means is made of a metallic material.

10. A finger-mounted tool device as claimed in claim 8, wherein the spring material of said finger-gripping means is made of a plastic or non-metallic material.

11. A finger-mounted tool device as claimed in claim 8, wherein said abrading means is formed of a flat shape.

12. A finger-mounted tool device as claimed in claim 8, wherein said abrading means is formed of a concave shape.

13. A finger-mounted tool device as claimed in claim 8, wherein said abrading means is formed of a convex shape.

14. A finger file device as claimed in claim 8, wherein said abrading means includes an abrasive member which has a length approximately equal to the length of said finger-gripping means.

15. A finger-mounted tool device comprising:

sleeve means for receiving a user's finger and for securely maintaining it on said user's finger during its use, said sleeve means having at least a first opening at one end;

said sleeve means being expandable diametrically so as to accommodate different thicknesses of the user's fingers; and abrading means being attached to said sleeve means.

16. A finger-mounted tool device as claimed in claim 15, wherein said sleeve means is formed from a spirally wrapped progression of spring material so as to allow for its expansion diametrically around the user's finger.

17. A finger-mounted tool device as claimed in claim 15, wherein said abrading means is formed of a flat shape.

18. A finger-mounted tool device as claimed in claim 15, wherein said abrading means is formed of a concave shape.

19. A finger-mounted tool device as claimed in claim 15, wherein said abrading means is formed of a convex shape.

20. A finger file device as claimed in claim 15, wherein said abrading means includes an abrading member which has a length approximately equal to the length of said sleeve means.

* * * * *